US009113729B2

(12) United States Patent
Righetti et al.

(10) Patent No.: US 9,113,729 B2
(45) Date of Patent: Aug. 25, 2015

(54) STIRRER OR SPOON DISPENSER FOR BEVERAGE DISPENSING MACHINES

(75) Inventors: Marco Righetti, Camugnano (IT); Marco Talini, Granaglione (IT)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 159 days.

(21) Appl. No.: 13/639,732

(22) PCT Filed: Apr. 20, 2011

(86) PCT No.: PCT/IB2011/051711

§ 371 (c)(1), (2), (4) Date: Oct. 5, 2012

(87) PCT Pub. No.: WO2011/135490

PCT Pub. Date: Nov. 3, 2011

(65) Prior Publication Data

US 2013/0032609 A1 Feb. 7, 2013

(30) Foreign Application Priority Data

Apr. 26, 2010 (EP) ..... 10161002

(51) Int. Cl.

| | |
|---|---|
| ***G07F 11/04*** | (2006.01) |
| ***G07F 11/22*** | (2006.01) |
| ***G07F 11/24*** | (2006.01) |
| ***A47F 1/10*** | (2006.01) |

(52) U.S. Cl.

CPC ..... *A47F 1/10* (2013.01)

(58) Field of Classification Search

CPC ..... G07F 11/04; G07F 11/22; G07F 11/14; G07F 11/24; G07F 11/44; G07F 11/10; G07F 11/20; G07F 11/32; G07F 11/08; G07F 11/12; G07F 11/16

USPC ..... 221/268, 48, 103; 220/23.83

See application file for complete search history.

(56) References Cited

U.S. PATENT DOCUMENTS

| | | | | | |
|---|---|---|---|---|---|
| 3,313,452 | A | * | 4/1967 | Katz | 221/268 |
| 3,483,361 | A | * | 12/1969 | Blurton | 235/384 |
| 3,938,700 | A | * | 2/1976 | Camp et al. | 221/109 |
| 4,017,001 | A | * | 4/1977 | Barthalon et al. | 221/5 |
| 4,583,657 | A | * | 4/1986 | Finn | 221/199 |
| 4,770,591 | A | * | 9/1988 | Wright et al. | 414/331.14 |
| 4,896,792 | A | * | 1/1990 | Marchand | 221/11 |
| 5,172,828 | A | * | 12/1992 | Ficken et al. | 221/11 |
| 5,351,854 | A | * | 10/1994 | Hagopian | 221/107 |

(Continued)

FOREIGN PATENT DOCUMENTS

WO 2008058187 A2 5/2008

*Primary Examiner* — Rakesh Kumar

(57) ABSTRACT

A stirrer dispenser for beverage dispensing machines includes a first channel for containing a stack of stirrers. The first channel includes a first opening from which single stirrers are extracted and ejected by an ejector provided with an alternating movement. The ejector includes an engagement member where single stirrers are engaged and ejected from the first opening at each stroke of the ejector. The dispenser further includes a second channel with a second opening. The second channel is located next to the first channel. The first and second openings are side by side along the movement direction of the ejector. In addition, the dispenser includes a stroke delimiter that limits the stroke of the ejector when at least one stirrer is present in the first channel, so that the ejector picks up the stirrers from the second channel only when the first channel is empty.

14 Claims, 7 Drawing Sheets

(56) References Cited

U.S. PATENT DOCUMENTS 5,605,249 A * 2/1997 Gonyea ..... 221/6
5,862,942 A * 1/1999 Yuyama et al. ..... 221/25
8,210,364 B2 * 7/2012 Smith et al. ..... 211/70.7
2008/0128445 A1 * 6/2008 Huang et al. ..... 221/7
2010/0084418 A1 4/2010 Reinsel et al.

* cited by examiner

STIRRER OR SPOON DISPENSER FOR BEVERAGE DISPENSING MACHINES

TECHNICAL FIELD

The present invention relates to improvements to devices for beverage dispensing machines, for example automatic dispensers or the like. More in particular, the present invention relates to improvements to dispensers of spoons, the so-called stirrers, for beverage dispensing machines.

PRIOR ART

Automatic beverage dispensers, especially of hot beverages such as coffee or the like, dispense a beverage directly into a cup that the user can pick up at the end of the dispensing cycle from a special opening in the automatic dispenser. A spoon is also inserted in the cup, according to the type of beverage selected, for stirring the beverage. This spoon actually consists of a stick of plastic material, generally referred to as stirrer.

The automatic dispensers or beverage dispensers of this type therefore comprise a stirrer dispenser, for example mounted on the closing door of the automatic dispenser, provided with a store or container for the stirrers, which must be filled periodically, as well as the other containers of consumables and ingredients for making the beverages.

The traditional stirrer dispensers comprise a channel or column for containing a stack of stirrers. The channel exhibits a bottom opening wherefrom single stirrers are extracted and ejected to fall into the cup previously positioned in the beverage dispensing zone. The single stirrers are extracted and ejected by an ejector provided with an alternating movement, usually an oscillation, and arranged underneath the channel forming the stirrer store.

Once the store has emptied, the automatic dispenser still operates but does not dispense stirrers and therefore the user cannot stir the beverage dispensed, until a maintenance technician fills the stirrer store again. This store has a limited capacity in that the channel containing the stock of said stirrers cannot have any height but is limited at the bottom in that the outlet height of the stirrers from the channel must be higher than the height whereat the cup where the beverage is dispensed is arranged. At the top, the channel height is limited by the machine size and in any case, by the need of not making the store refill operation too uncomfortable, thus preventing the channel inlet from being at too high a height, not easily reachable by the personnel in charge of maintenance.

SUMMARY OF THE INVENTION

The object of the present invention is to provide a stirrer dispenser for beverage dispensing machines which can contain a large number of stirrers and which has a simple and reliable structure.

This and other objects and advantages, which shall be apparent to those skilled in the art from reading the text below, are achieved with a stirrer dispenser for beverage dispensing machines and the like, comprising at least two channels side by side defining a dual stirrer store, whereto a single ejector is associated, movable with an alternating motion, for example oscillation, which at each stroke picks up a single stirrer from the side by side channels. The ejector is associated to a stroke delimiter that limits the stroke of said ejector when at least one stirrer is present in the first channel, so that the ejector picks up the stirrers from the second channel only when the first channel is empty.

The side by side channels may be more than two.

According to some particularly advantageous embodiments, the stroke delimiter comprises, integral to the ejector, an abutment that interferes with the stirrers loaded in the first channel, so that until there is provided at least one stirrer in said first channel, the ejector is prevented from picking up stirrers from the adjacent channel.

This embodiment is very simple as it minimises the moving parts of the device.

In some embodiments, the abutment may be retractable for facilitating the stirrer discharge, but this is not necessary especially if such abutment is suitably positioned in side position for facilitating the stirrer discharge. When the abutment is retractable, the retraction movement may be controlled by a fixed cam with which the ejector cooperates in its stirrer dispensing movement.

In other embodiments, the stroke delimiter may be carried by the store and controlled so as to take a hidden position relative to the ejector when the first channel is empty and an extracted position and interfering with the ejector when the first channel is full. The stroke delimiter movement may be controlled by the same presence or absence of stirrers in the respective channel, or by a member associated to the stirrers, for example a weight or a spring that pushes the stirrers towards the outlet of the containment channel. In this way, when both channels contain stirrers, the stroke delimiter is in extracted position and locks the ejector so that it arranges at the first channel and picks up the stirrers from the latter. When the first channel is empty, the stroke delimiter hides or deactivates and the ejector performs a longer stroke to pick up the stirrers from the second channel.

The arrangement may be multiplied for a larger number of channels.

On the other hand, when the stroke delimiter is carried by the ejector, a single delimiter is sufficient also in the presence of a larger number of stirrer containment channels, side by side to each other.

In the practice, according to some advantageous embodiments of the invention, the ejector is controlled for performing an alternating movement comprising a loading stroke, wherewith the ejector is moved to a position for picking up a stirrer from a first channel or from a second channel, and an ejection stroke, wherewith the ejector is moved from the pick up position to an ejection position. Moreover, the stroke delimiter limits the loading stroke of the ejector so that the pick up position corresponds to the opening of the stirrer dispensing from the first channel when in the first channel there is at least one stirrer, whereas when the first channel is empty, the pick up position corresponds to the opening of the stirrer dispensing from the second channel.

The ejector movement may advantageously and preferably be an oscillation movement about an oscillation axis. In this case, the ejector will follow a circle arc trajectory. In other embodiments, the ejector may be provided with an alternating shifting movement, for example guided on rectilinear guides. In this case, the trajectory will be a rectilinear trajectory.

Preferably, the channels have a vertical development and are open at the bottom, so that the stirrers are fed to the ejector by simple gravity, optionally with the aid of weights located on top of the stacks of stirrers in the two or more side by side channels. It would also be possible, however, to arrange the channels with top openings, towards which the stirrers may be fed and pushed, for example through underlying elastic members.

Further features and embodiments of the invention are indicated in the annexed claims, which form an integral part of the present invention.

According to a different aspect, the present invention relates to an automatic beverage dispenser or other beverage dispensing machine, comprising a stirrer or spoon dispenser as defined above.

BRIEF DESCRIPTION OF THE DRAWINGS

The invention will be better understood by following the description and accompanying drawings, which show a non-limiting practical embodiment of the invention. More in particular, in the figures.

DETAILED DESCRIPTION OF AN EMBODIMENT OF THE INVENTION

Figure 1:
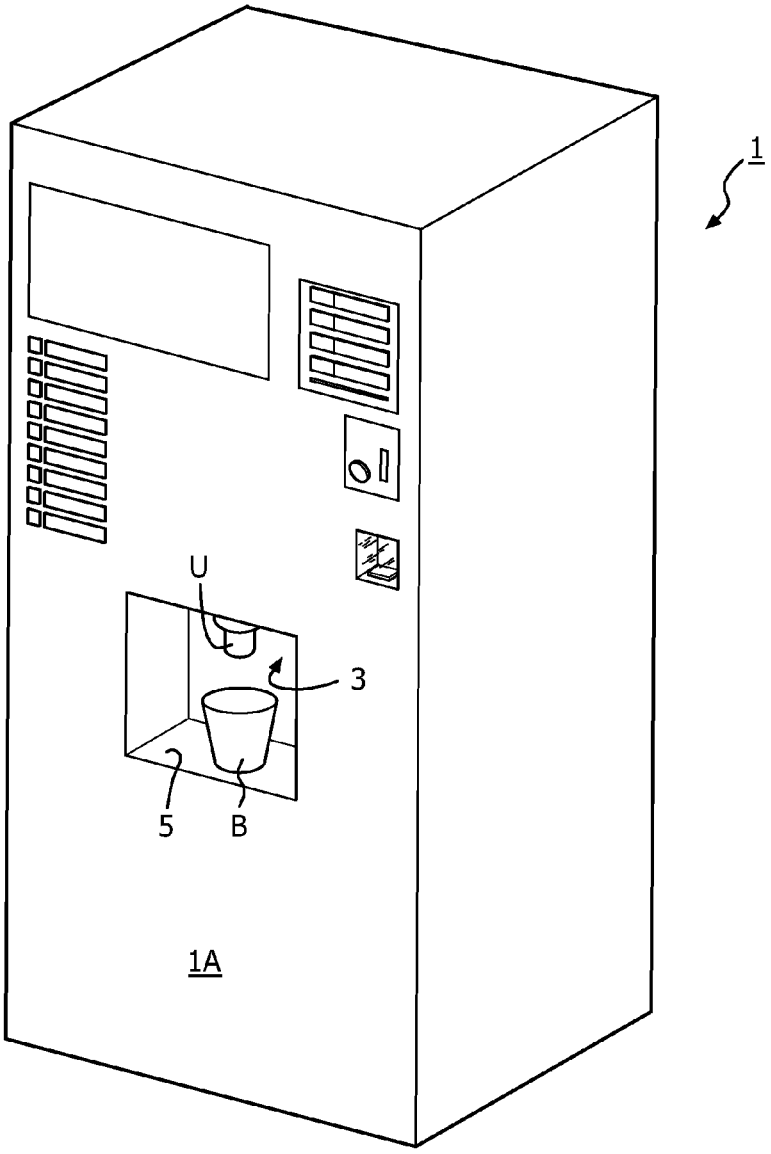
FIG. 1 shows a schematic perspective view of an automatic dispenser wherein the invention may be embodied.

FIG. 1 schematically shows a beverage dispensing machine wherein the present invention may be embodied. The machine is globally indicated with reference numeral 1. It exhibits a front wall 1A, for example defined by an access door, wherein there is provided a cavity 3, optionally closed by a sliding door, wherein there is provided a surface 5 whereon the machine arranges a cup B whenever a beverage dispensing cycle is actuated. Above the position wherein cup B is arranged there are provided one or more dispensing nozzles for the beverages which may be selected by the user. The figure shows a globally indicates with U a group of nozzles for dispensing various beverages.

Inside the machine room there is provided a stirrer or spoon dispenser, arranged so as to discharge a single stirrer into a cup B that is arranged on surface 5. The following Figures show the stirrer dispenser and its operation in greater detail.

Figure 2:
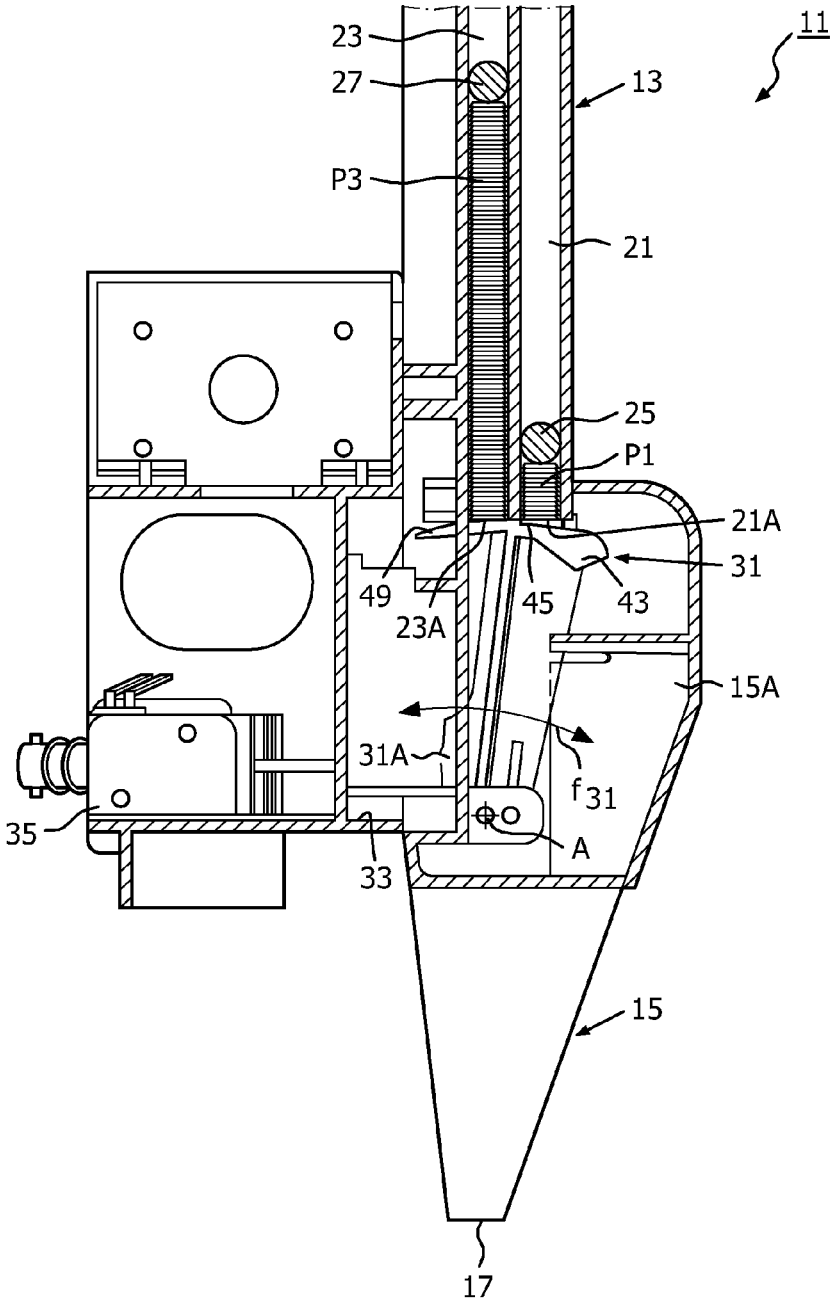
FIGS. 2 and 3 show vertical sections of the stirrer dispenser in two positions when both stirrer containment channels contain a certain amount of stirrers.
Figure 3:
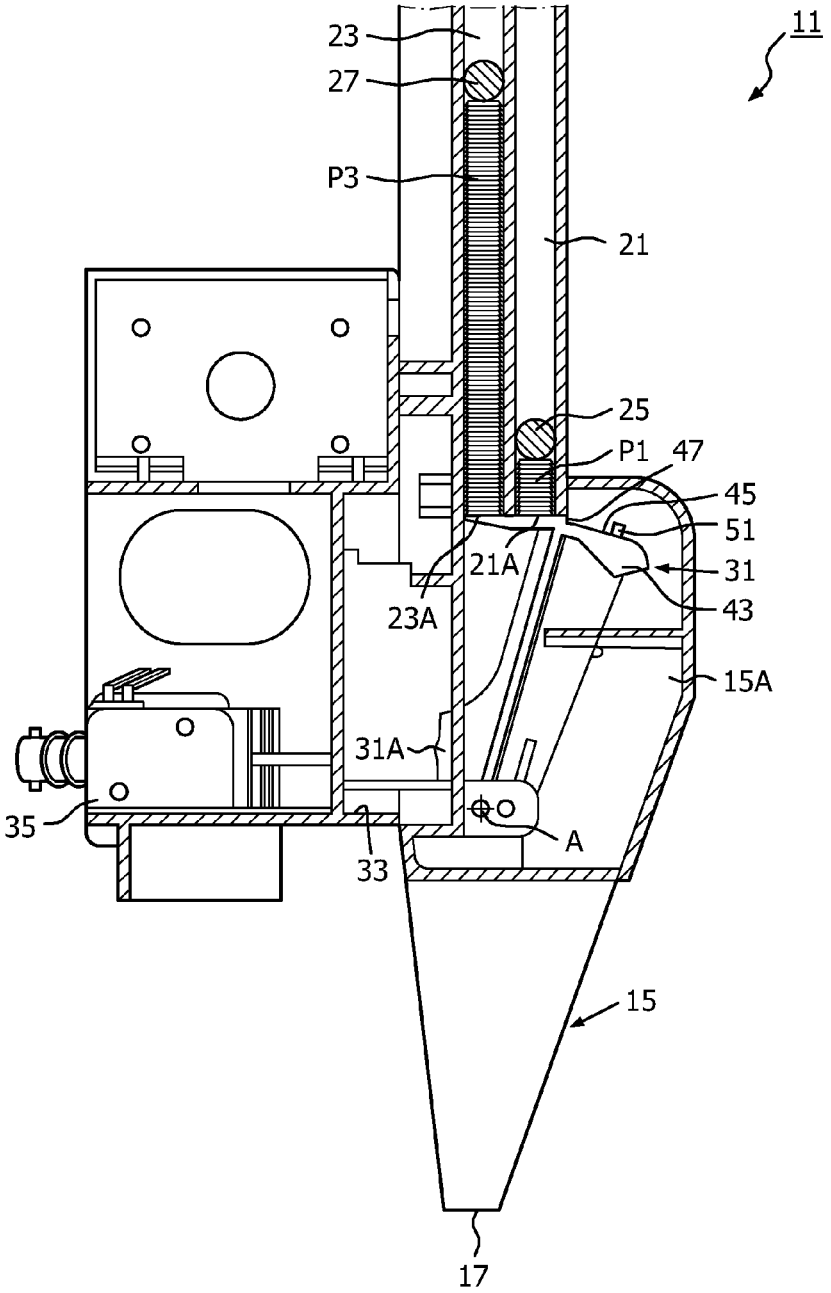

With particular reference to FIGS. 2 and 3 the dispenser, globally indicated with reference numeral 11, comprises as stirrer store 13 on top of a discharge hopper 15 ending with an outlet 17 on top of surface 5, wherefrom a single stirrer is each time discharged into cup B arranged on the underlying surface 5.

According to some embodiments, the stirrer store 13 comprises a first channel 21 with vertical development and a second channel 23, with vertical development as well and side by side with channel 21. Stacks of stirrers are inserted in the two channels 21 and 23, respectively indicated with P1 and P3. On top of each one of the two stacks P1 and P3 of stirrers, weights 25 and 27 are advantageously placed which push the same stirrers downwards ensuring a gradual descent thereof as they are picked up from the bottom zone of store 13 by an ejector 31, the structure and the operation whereof shall be described hereinafter.

Channels 21 and 23 exhibit bottom openings respectively indicated with 21A and 23A, underneath which there is arranged ejector 31. The latter is articulated to a fixed structure 33 about an oscillation axis A. The oscillation of ejector 31 according to the dual arrow f31 is controlled by an actuator. In FIGS. 2, 3, 6 and 7, the actuator is shown in the shape of an electromagnet, the anchor whereof is constrained to ejector 31 so that the movement of the anchor controlled by the electromagnet causes the oscillation of ejector 31.

Figure 4:
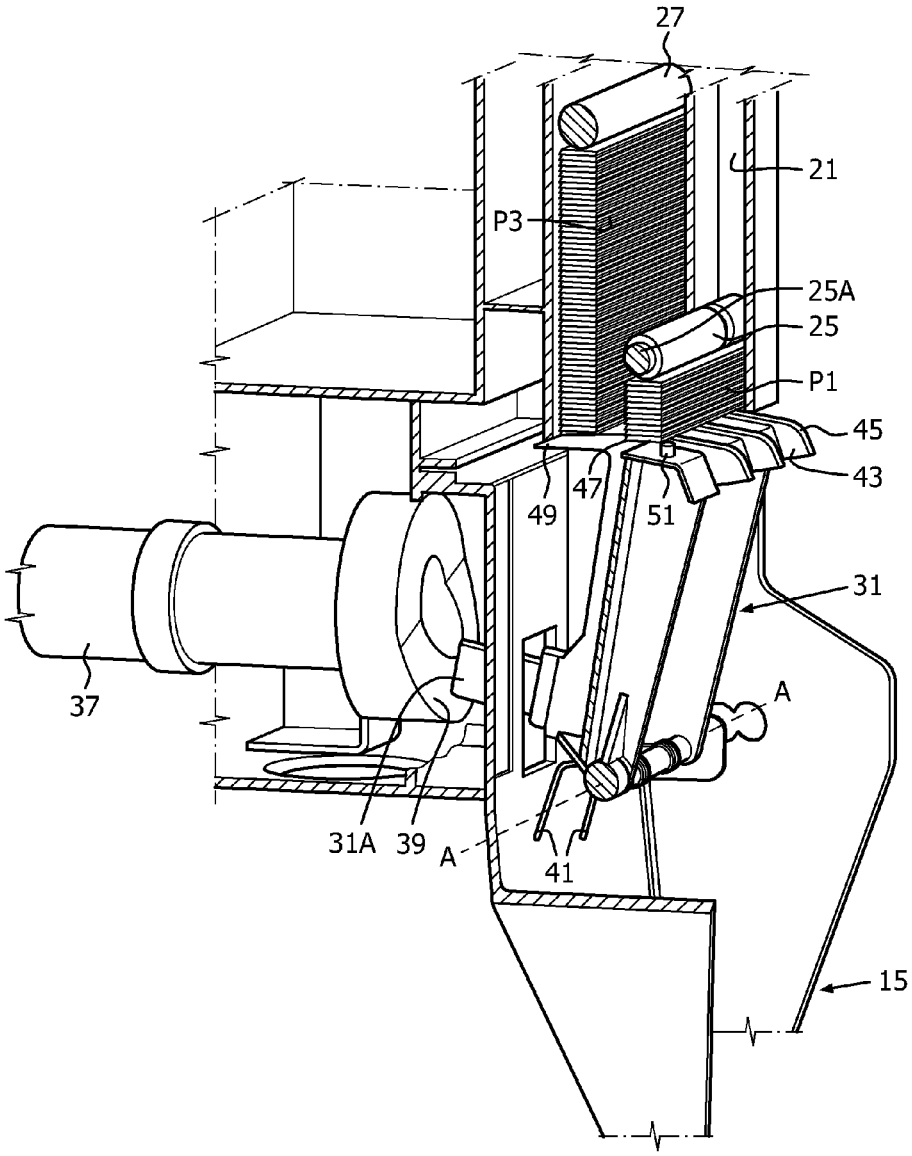
FIG. 4 shows a perspective and cutaway view of an embodiment version of the dispenser of FIGS. 2 and 3 in the position of FIG. 2.
Figure 5:
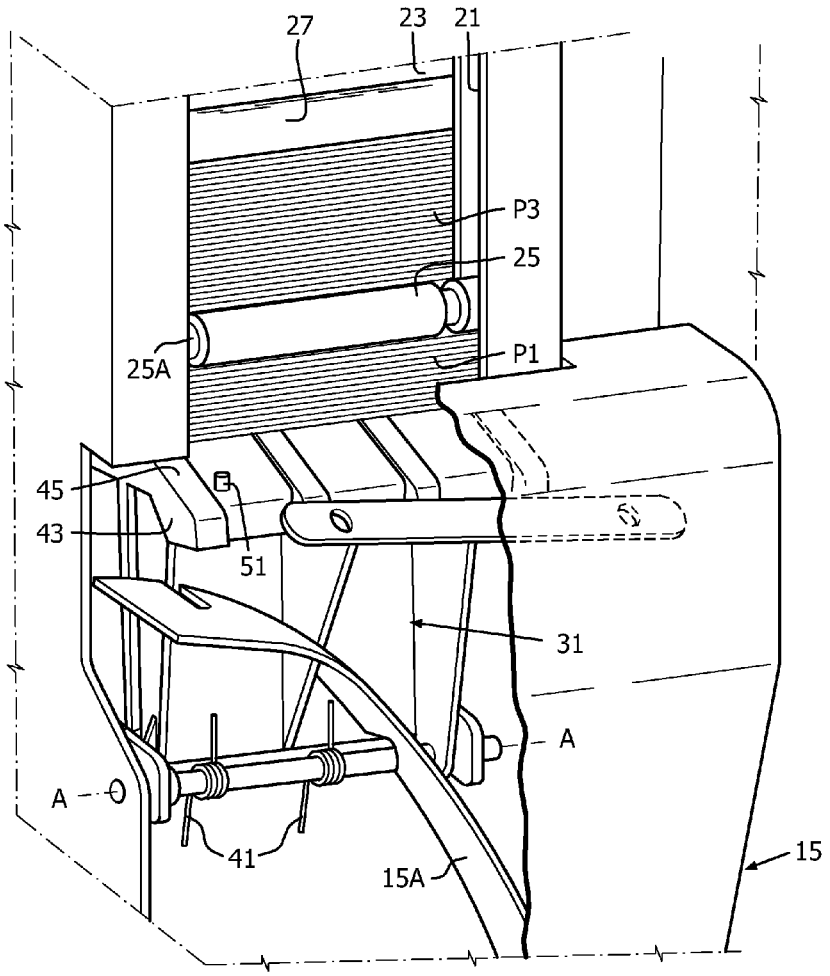
FIG. 5 shows a perspective and cutaway view of the dispenser in a step of ejection or dispensing of a stirrer.

In other embodiments, shown as embodiment version in FIGS. 4 and 5, the actuator comprises an electrical motor 37 provided with a front cam 39 that cooperates with an appendix 31A of ejector 31, constituting a feeler of the front cam 39. Ejector 31 is stressed, for example by a helical spring 41, so as to be pushed in support with feeler 31A against the front cam profile 39. The rotation of motor 37 causes, through the rotation of the front cam 39, the oscillation movement of ejector 31.

The device of FIGS. 4 and 5 is the same as the device of FIGS. 2, 3, 6 and 7 with the exception of the actuator used for controlling ejector 31.

Ejector 31 at the top exhibits a shaped wall 43 that defines a seat 45 for the single stirrers that must be picked up from store 13 and dispensed into cup B. Seat 45 is delimited by a step, tooth or projection 47 that forms the gripping element of the single stirrers from the one and the other of channels 21 and 23 forming store 13. Behind step 47 delimiting the seat of the single stirrers 45, the wall extends to form a retaining surface 49 that serves for retaining the stirrers within channels 21 and 23 when ejector 31 is made to oscillate for ejecting a single stirrer from the store.

Figure 6:
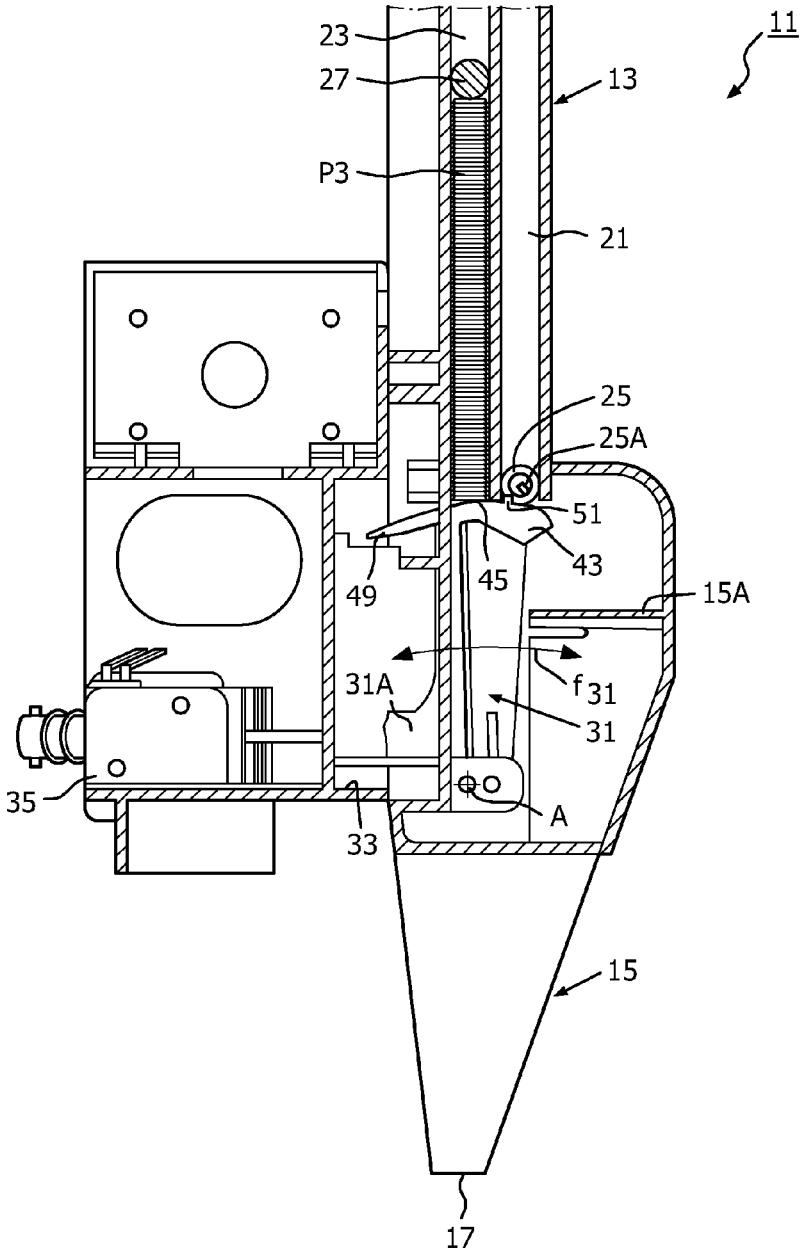
FIGS. 6 and 7 show sections similar to those of FIGS. 2 and 3 with the first containment channel empty.
Figure 7:
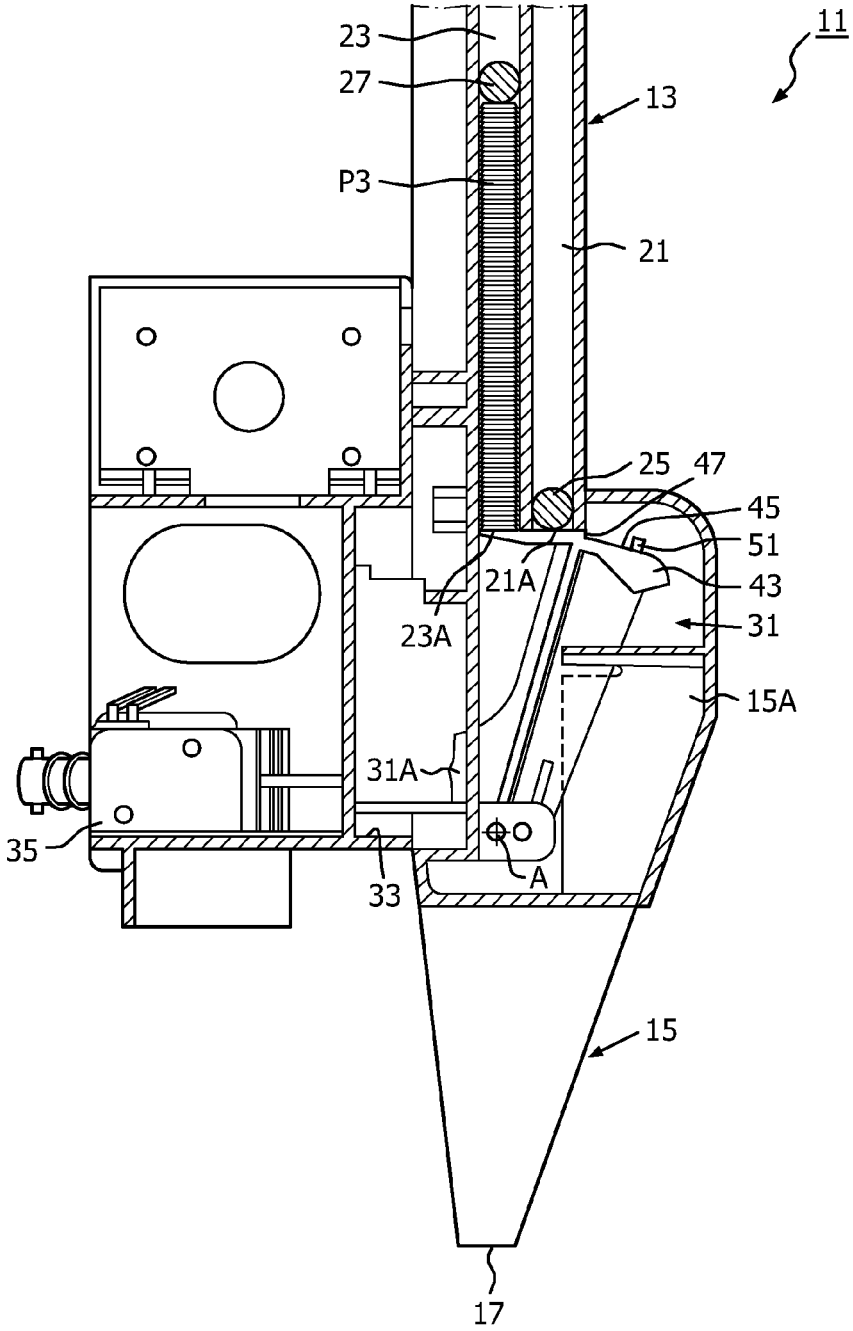

In the embodiment shown, ejector 31 is associated to a stroke delimiter that limits the oscillation stroke of ejector 31 towards the rest position when channel 21 contains at least one paddle. As shown in FIG. 2, when channel 21 is not empty, the ejector stops at a more advanced rest position relative to that it takes when channel 21 is empty (FIG. 6). As shall be clarified hereinafter, in this way ejector shall first finish stirrers P1 in channel 21 and only after it shall start picking up stirrers P3 from channel 23.

In some embodiments, the stroke delimiter consists of an abutment 51. Preferably, abutment 51 consists of a pin arranged in side position relative to the longitudinal development of wall 43 and thus of the seat for stirrers P1, P3 defined by step or projection 47.

As is seen in particular in FIGS. 2, 4, when at least one stirrer P1 is in channel 21, the abutment pin 51 interferes with this stirrer so as to prevent ejector 31 from oscillating beyond the position shown in such figure. In this position, any oscillation of ejector 31 in clockwise direction (in the figure) causes the grip by tooth or step 47 of the stirrer in a lower position into channel 21 and the pulling thereof outside the channel itself, up to making it fall into hopper 15 (FIG. 3, FIG. 5). A curved wall 15A is positioned into the latter, which imposes such trajectory to the same stirrer that it orientates about in vertical position for properly falling into cup B.

When channel 21 is empty, that is, after the ejection of the last stirrer P1 contained therein, the return stroke of ejector 31 is not hindered anymore by the interference of abutment 51 with the stirrer(s) P1 into channel 21 and thus the same ejector arranges in the position shown in FIG. 6. In this position step, tooth or projection 47 is behind the lowest stirrer P3 in channel 23, whereas seat 45 is underneath the stack of stirrers P3. The subsequent oscillation movement for ejecting a new stirrer therefore causes the extraction of the stirrer in lower position into channel 23 and the pulling thereof to hopper 15. The subsequent oscillation up to the position of FIG. 7 leads to the ejection of a stirrer P3 from channel 23 to hopper 15.

A very simple mechanism is thus obtained with no additional cost compared to the traditional mechanisms, which allows feeding stirrers P1, P3 coming first from channel 21 and then from channel 23 when channel 21 is empty.

Since the size of each channel 21, 23 in the horizontal direction according to the width direction of the stirrers is very limited, arranging two channels (or even more than two channels) one next to the other in orthogonal direction relative to the longitudinal stirrer development does not imply an increase of the overall dimensions, that is, it occupies a machine zone that in any case is free from other mechanisms. The addition of a second channel 23 to a first channel 21 allows doubling the capacity of store 13. The addition of two channels besides channel 21 triples the capacity of a standard store, and so on. In fact, while the example shown refers to a solution with only two channels 21, 23 side by side, it is easy to implement solutions with a larger number of channels. All that needs changing is the extension of the retaining surface 49 integral to ejector 31. Its extension beyond tooth or step 47 increases as the number of adjacent channels increases, as it shall ensure the bottom retaining of all the stacks of stirrers side by side in the various channels.

To prevent the abutment pin 51 from interfering with weight 25 positioned in channel 21, so as to allow the oscillation of ejector 21 to the position of FIG. 6 when channel 21 is empty, weight 25 advantageously has a cylindrical shape with a length equal to that of the channel, but with a reduced diameter zone, indicated with reference numeral 25A in FIGS. 4 and 5. This reduced diameter zone corresponds to the side position wherein the abutment pin 51 is. In this way, when weight 25 reaches its lower position at the outlet opening 21A, it does not interfere with abutment 51. In other embodiments it is possible to replace the weights with other members, for example elastic elements, which may exhibit a smaller width than the channel length, thus avoiding the interference with abutment 51. In some embodiments, weights 25, 27 may also be omitted.

The invention has been described and illustrated in detail with reference to a possible embodiment thereof. However, drawings and description should be understood as exemplary and non-limiting; the invention is not limited to the illustrated embodiment.

For example, as mentioned above, the stirrer seating channels may be more than two. They may also be oriented with the stirrer outlet opening upwards, rather than downwards. In this case, there may be provided a pushing element, for example an elastic system, which advances the stirrers towards the channel openings. The ejector may be provided with an alternating shifting movement, for rather than an oscillating movement. The movement may be controlled by any kind of actuator. Moreover, while it is preferable (as shown) to arrange an abutment on the ejector, fixed relative thereto, as this makes the device particularly simple and reliable, in other embodiments the abutment may be carried by the ejector but controlled so as to be able to take an operating position and a non-operating position, for example for facilitating the discharge of the stirrer picked up by the ejector. In further alternative embodiments, the abutment may be carried by a fixed portion of the device, that is, not be movable with the ejector, and be controlled for taking different positions according to the channel filling conditions. For example, the abutment may be in operating position when at least one stirrer is present in the first channel, while it may be refracted in a non-operating position when the first channel is empty. The abutment movement may be controlled for example by a weight arranged on top of the stirrers to facilitate the descent thereof, or by a stirrer sensor associated to the first channel.

Any reference numbers in the claims do not limit the scope of protection thereof, but are provided to facilitate reading of the claims with reference to the description and to the annexed drawings.

The invention claimed is:

1. A stirrer dispenser for beverage dispensing machines, comprising:

a first channel for containing a first stack of stirrers;

a second channel for containing a second stack of stirrers, said first channel having a first opening and said second channel having a second opening;

an ejector provided with an alternating movement and having an engagement member and a stroke delimiter, the engagement member being configured to engage a stirrer from one of said first opening and said second opening at each stroke of said ejector, and the stroke delimiter being configured to limit the stroke of said ejector when at least one stirrer is present in said first channel, wherein the ejector engages the stirrers from the second channel only when the first channel is empty, wherein said ejector comprises a seat for the stirrer; a retaining surface for retaining the first stack of stirrers into the first channel and the second stack of stirrers into the second channel, the retaining surface being arranged next to said seat; and a step between said seat and said retaining surface for engaging the stirrer to be dispensed from the stirrer dispenser; and wherein said stroke delimiter comprises an abutment fixed to the seat for interfering with the stirrers contained in the first channel.

2. The dispenser according to claim 1, wherein the alternating movement includes a loading stroke to move the ejector to a picking position for picking up the stirrer from one of said first opening and said second opening, and an ejection stroke to move the ejector from the picking position to an ejection position; and wherein said stroke delimiter limits the loading stroke of the ejector so that the picking position corresponds to the first opening of the first channel when at least one stirrer is present in the first channel, whereas when the first channel is empty, the picking position corresponds to the second opening of the second channel.

3. The dispenser according to claim 1, wherein said abutment is arranged at an end of said seat.

4. The dispenser according to claim 1, wherein said retaining surface has a size configured to close both said first opening and said second opening when the ejector is in the ejection position.

5. The dispenser according to claim 1, wherein said first channel and said second channel are arranged vertically within said dispenser; said first opening and said second opening are arranged at bottom ends of said first channel and of said second channel, respectively; a first weight and a second weight are arranged in said first channel and said second channel, respectively, for acting on the first and second stacks of stirrers, respectively; and the first weight is shaped for not interfering with said stroke delimiter.

6. The dispenser according to claim 1, wherein said alternating movement is an oscillation movement.

7. A stirrer dispenser for beverage dispensing machines, comprising:

a first channel for containing a first stack of stirrers;

a second channel for containing a second stack of stirrers, the first channel having a first opening and the second channel having a second opening; and an ejector provided with an alternating movement and having an engagement member configured to engage a stirrer from one of the first opening and the second opening at each stroke of the ejector, the ejector further having a stroke delimiter configured to limit the stroke of the ejector when at least one stirrer is present in the first channel, wherein the ejector engages the stirrers from the second channel only when the first channel is empty, wherein the stroke delimiter comprises an abutment for contacting the at least one stirrer present in the first channel and preventing further movement of the ejector, wherein stirrers from the first stack of stirrers do not contact stirrers from the second stack of stirrers during the alternating movement of the ejector.

8. The stirrer dispenser of claim 7, wherein the ejector includes a seat for the stirrer and a retaining surface for retaining the first stack of stirrers into the first channel and the second stack of stirrers into the second channel, and wherein the engagement member comprises a step between the seat and the retaining surface.

9. The stirrer dispenser of claim 8, wherein the abutment is fixed to the seat.

10. The stirrer dispenser of claim 8, further comprising a weight located in the first channel over the first stack of stirrers, the weight having a recess for allowing passage of the abutment when the first channel is devoid of the first stack of stirrers.

11. A beverage dispensing machine comprising a stirrer dispenser for beverage dispensing machines, the stirrer dispenser comprising:

a first channel for containing a first stack of stirrers;

a second channel for containing a second stack of stirrers, the first channel having a first opening and the second channel having a second opening; and an ejector provided with an alternating movement and having an engagement member configured to engage a stirrer from one of the first opening and the second opening at each stroke of the ejector, the ejector further having a stroke delimiter configured to limit the stroke of the ejector when at least one stirrer is present in the first channel, wherein the ejector engages the stirrers from the second channel only when the first channel is empty, wherein the stroke delimiter comprises an abutment for contacting the at least one stirrer present in the first channel and preventing further movement of the ejector, and wherein the ejector includes a seat for the stirrer and a retaining surface for retaining the first stack of stirrers into the first channel and the second stack of stirrers into the second channel, and wherein the engagement member comprises a step between the seat and the retaining surface.

12. The beverage dispensing machine of claim 11, further comprising a weight located in the first channel over the first stack of stirrers, the weight having a recess for allowing passage of the abutment when the first channel is devoid of the first stack of stirrers.

13. The beverage dispensing machine of claim 11, wherein stirrers from the first stack of stirrers do not contact stirrers from the second stack of stirrers during the alternating movement of the ejector.

14. The beverage dispensing machine of claim 11, wherein the abutment is fixed to the seat.

* * * * *